US005746342A

United States Patent [19]

Jacques et al.

[11] Patent Number: 5,746,342

[45] Date of Patent: May 5, 1998

[54] FIVE-PIECE CONTAINER WITH HINGEABLE SIDES

[75] Inventors: Michel Jacques, St.-Damien-de-Buckland; Roch Nolet, St-Joseph-de-Beauce, both of Canada

[73] Assignee: IPL, Inc., Quebec, Canada

[21] Appl. No.: 906,347

[22] Filed: Aug. 5, 1997

Related U.S. Application Data

[63] Continuation of Ser. No. 696,241, Aug. 13, 1996, abandoned.

[51] Int. Cl.[6] ..... B65D 21/00

[52] U.S. Cl. ..... 220/6; 220/7

[58] Field of Search ..... 220/6, 7

[56] References Cited

U.S. PATENT DOCUMENTS

| | | | |
|---|---|---|---|
| 3,246,828 | 4/1966 | Branscum et al. | 220/6 X |
| 3,973,692 | 8/1976 | Cloyd | 220/7 |
| 4,005,795 | 2/1977 | Mikkelsen et al. | 220/6 X |
| 4,081,099 | 3/1978 | Shead | 220/6 |
| 4,170,313 | 10/1979 | Caves et al. | 220/7 |
| 4,643,314 | 2/1987 | Kidd | 220/6 X |
| 4,940,155 | 7/1990 | Hewson | 220/6 |
| 5,515,987 | 5/1996 | Jacques et al. | 220/6 |
| 5,538,153 | 7/1996 | Marovskis et al. | 220/6 |

*Primary Examiner*—Steven M. Pollard

*Attorney, Agent, or Firm*—Wells, St. John, Roberts, Gregory & Matkin, P.S.

[57] ABSTRACT

A five-piece container for items, such as bottles, comprises a bottom piece, a pair of side pieces of identical height and a pair of end pieces also of identical height; each side edge and each end edge of the bottom piece display a series of planar surfaces interspaced with a series of recessed areas in which is defined a hinge that engagedly receives a C-shaped extension formed at the lower edge of each side piece and of each end piece so that the side and end pieces may be mounted to the bottom piece through a snap engagement. The end pieces and the side pieces can be moved between an outward foldback position and an erected position; however, an inward folded position cannot be effected due to the configuration of the lower edge of the side pieces and of the end pieces and that of the edges of the bottom piece. The folding configuration is useful for containers that have walls higher than the width of the bottom thus preventing the walls from being folded inside.

10 Claims, 6 Drawing Sheets

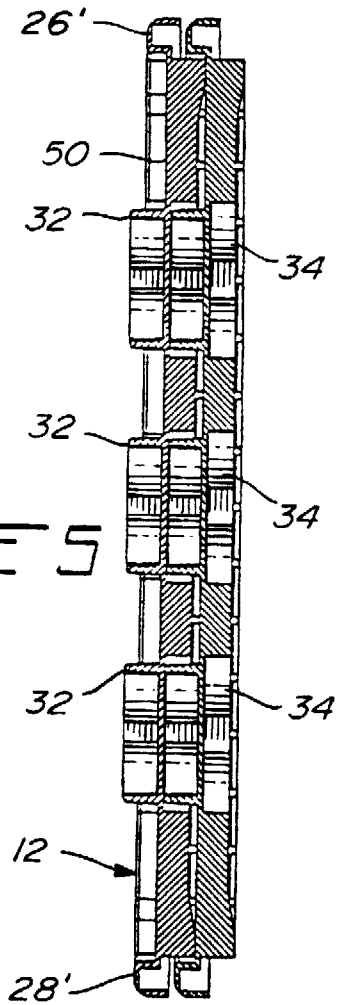
FIG. 5
FIG. 4
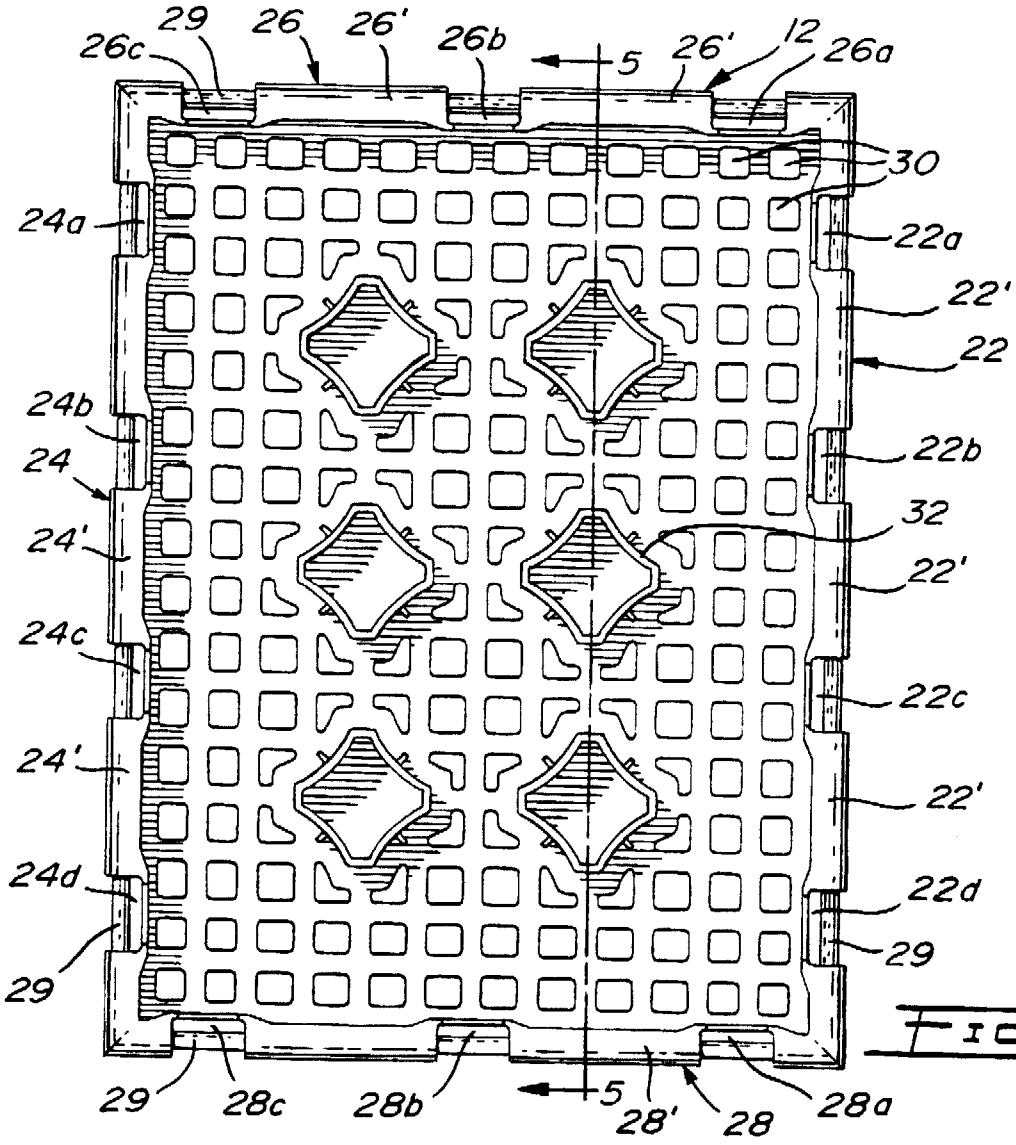

FIVE-PIECE CONTAINER WITH HINGEABLE SIDES

CROSS REFERENCE TO RELATED APPLICATION

This is a file wrapper continuation of U.S. patent application Ser. No. 08/696,241, filed Aug. 13, 1996, and titled "FIVE-PIECE CONTAINER WITH HINGEABLE SIDES" now abandoned.

FIELD OF THE INVENTION

The present invention relates to a plastic container for carrying items, such as bottles, and, more particularly, to a five-piece container consisting of a bottom and of four sides which can be moved between an erected position and an outward foldback position.

BACKGROUND OF THE INVENTION

Containers for carrying items, such as bottles, are made of injection molded plastics material to replace containers which were previously made from wood or cardboard. Plastic containers can be easily cleaned and washed so that they may be reused frequently. They can also be repaired or recycled.

Up until now, plastic containers have included many components (in some cases up to fourteen) some of which are metallic, such as rods acting as hinges for the folding and/or erecting of the sides relative to the bottom. If the containers need to be washed, the metallic components must first be removed in order to prevent them from corroding. Furthermore, such containers are difficult to repair and costly to recycle since the metal components must again be separated from the plastic parts before recycling the plastic parts.

One plastic container, free of metallic components may be found described in applicant's U.S. patent application Ser. No. 08/502,168 filed Jul. 13, 1995. However, this container is constructed so that it may be moved between three positions, namely, an inward folded position, an erected position and an outward foldback position. Such a container, as well as the other containers of the prior art, must have walls smaller in height than the width of the bottom so that they may be allowed to be folded inwardly over the bottom wall.

OBJECTS AND STATEMENT OF THE INVENTION

It is an object of the present invention to overcome the above problems with plastic containers by providing a five-piece plastic container which excludes metallic parts, which enables containers having sides with a height equal or greater than the width of the bottom and which may be cleaned and stacked when in its outward foldback position. Also, the sides and bottom being disengageable from one another, they may be repaired, recycled or replaced when worn.

The present invention therefore provides a five-piece container which comprises:

a bottom piece formed of plastics material, the bottom piece having a pair of opposite side edges and a pair of opposite end edges; the end edges having a given length;

a pair of side pieces of identical height formed of plastics material, each side piece having a lower edge; the height being greater than the length of the end edges of the bottom piece; and a pair of end pieces of identical height formed of plastics material, each end piece having a lower edge; each side edge and each end edge of the bottom piece displaying a series of planar surfaces, interspaced by a series of recessed areas, and a horizontally extending integrally formed hinge traversing each recessed area;

each lower edge of the side pieces and of the end pieces displaying a series of flat faces and a series of horizontally spaced extensions, each defining a C-shaped profile, between the faces; the extensions being so disposed along each lower edge as to be received within a corresponding one of the recessed areas for assembly of a side piece to the bottom piece; the profiles being configured to enable snap engagement and disengagement of the extensions with and from the hinges and to allow the side pieces to be moved between an outward foldback position and an erected position; the flat faces of the side pieces and of the end pieces contacting the planar surfaces of the bottom piece in the erected position thereby preventing the side pieces and the end pieces to move inwardly to an inwardly folded position.

In one form of the invention, the side edges and the end edges of the bottom piece have an identical height which is identical to the thickness of the side pieces and of the end pieces so that, in the outward foldback position, the side pieces and the end pieces lie in a plane which includes that of the bottom piece.

In another form of the invention, the bottom wall is so constructed that the containers, in the outward foldback position, may be stacked one onto the other as a result of the bottom wall having complementary shaped top and under sides.

Other objects and further scope of applicability of the present invention will become apparent from the detailed description given hereinafter. It should be understood, however, that this detailed description, while indicating preferred embodiments of the invention, is given by way of illustration only, since various changes and modifications within the spirit and scope of the invention will become apparent to those skilled in the art.

BRIEF DESCRIPTION OF THE DRAWINGS

FIG. 4 is a top plan view of the bottom wall;

FIG. 5 is a cross-sectional view taken along lines 5—5 of FIG. 4 and showing two stacked bottom walls;

DESCRIPTION OF PREFERRED EMBODIMENTS

Figure 1:
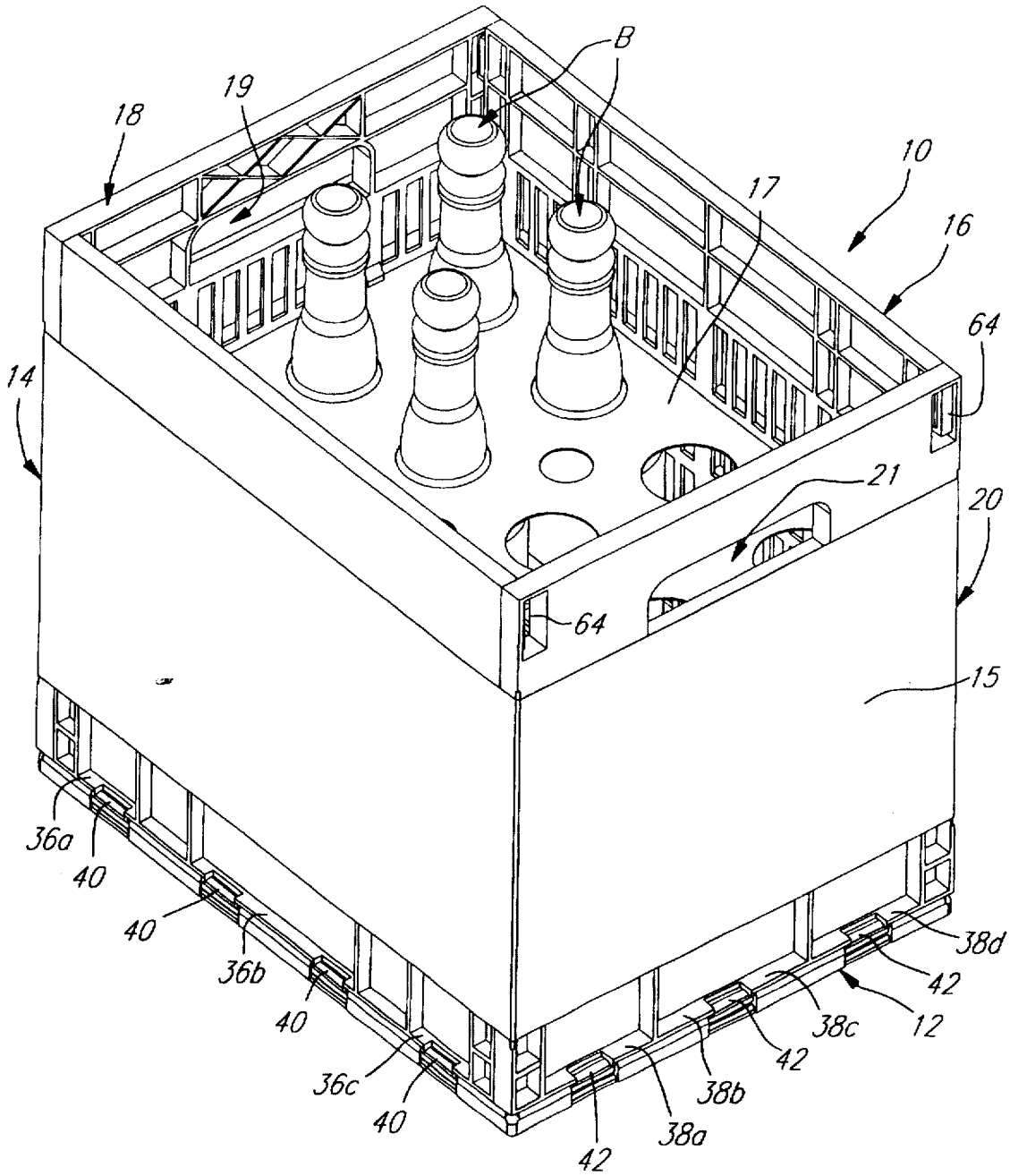
FIG. 1 is a perspective view of a container used for carrying bottles and shown in the side erected position.
Figure 2:
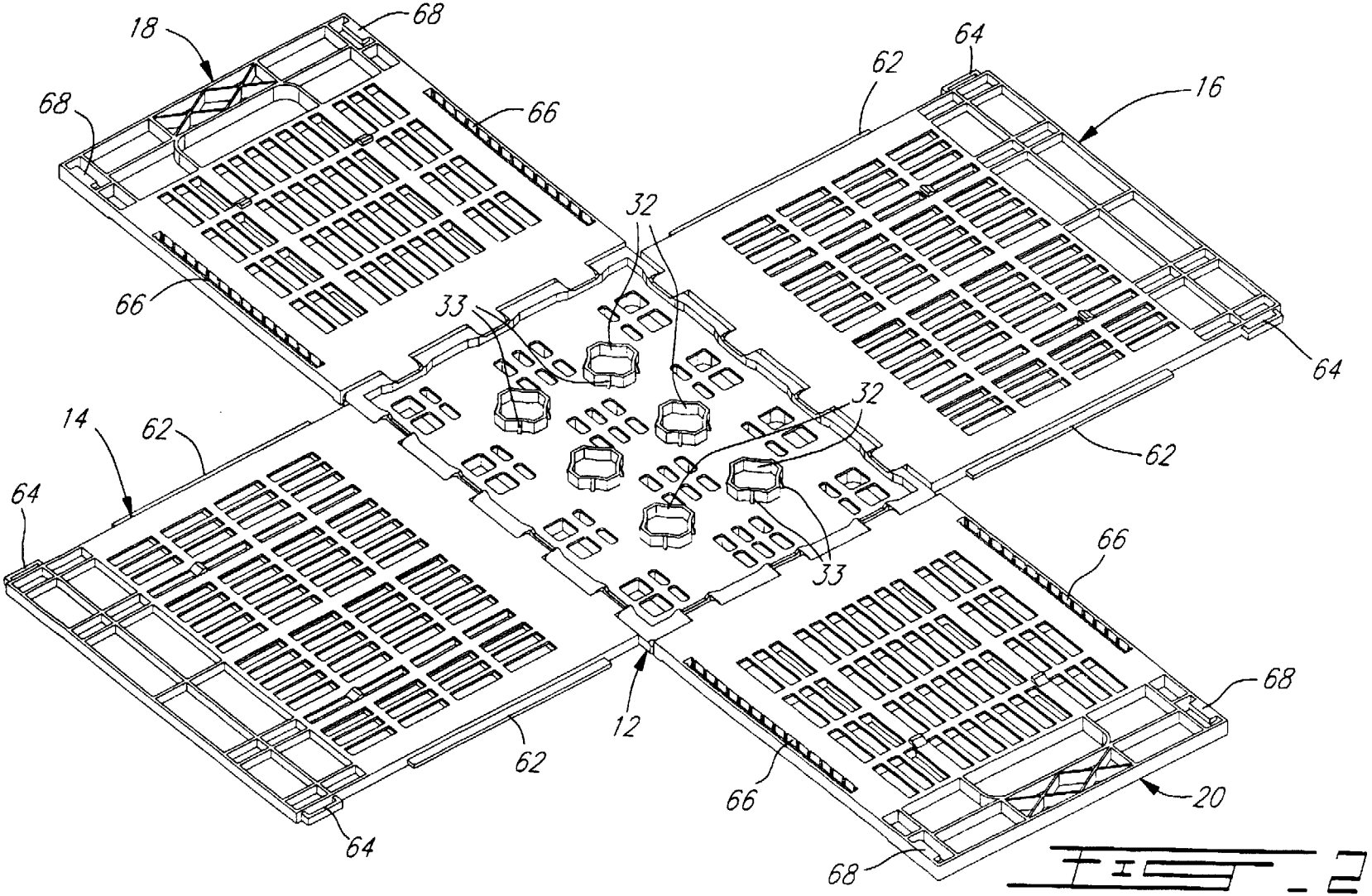
FIG. 2 is a perspective view of a container showing the sides in an outward foldback position.

Referring to FIGS. 1 and 2, there is shown a five-piece container, generally denoted 10, made entirely and solely of rigid plastics material. The container which is used to carry bottles B essentially consists of a bottom piece 12, of opposite side pieces 14 and 16 and of opposite end pieces 18 and 20. Handles 19 and 21 are provided in respective end pieces 18 ans 20 to facilitate manual handling of the container. The side pieces and the end pieces are provided with a series of rectangular openings that provide lightness to the container. FIG. 1 shows that the outer faces of the side and end pieces may be covered with a cardboard or like sheet 15 for advertisement.

A member 17 serves to retain the bottles in a vertical steady position in the container; the construction and function of member 17 are more fully described in applicant's copending application filed concurrently herewith.

The bottom piece 12 is rectangular with a pair of opposite side edges 22 and 24 and a pair of opposite end edges 26 and 28 (see also FIG. 4). In the embodiment illustrated, the side edges 22 and 24 have a length greater than that of the end edges 26 and 28. Each side edge and each end edge of the bottom piece 12 include a series of horizontally spaced recessed areas identified as 22*a*, 22*b*, 22*c* and 22*d* for side edge 22, as 24*a*, 24*b*, 24*c* and 24*d* for side edge 24, as 26*a*, 26*b* and 26*c* for end edge 26, and as 28*a*, 28*b* and 28*c* for end edge 28. Interspaced with all these recessed areas are respective planar surfaces 22', 24', 26' and 28' all extending in a common horizontal plane. Included in each recessed area is a cylindrical hinge 29 which is integrally formed with the edges.

Figure 3:
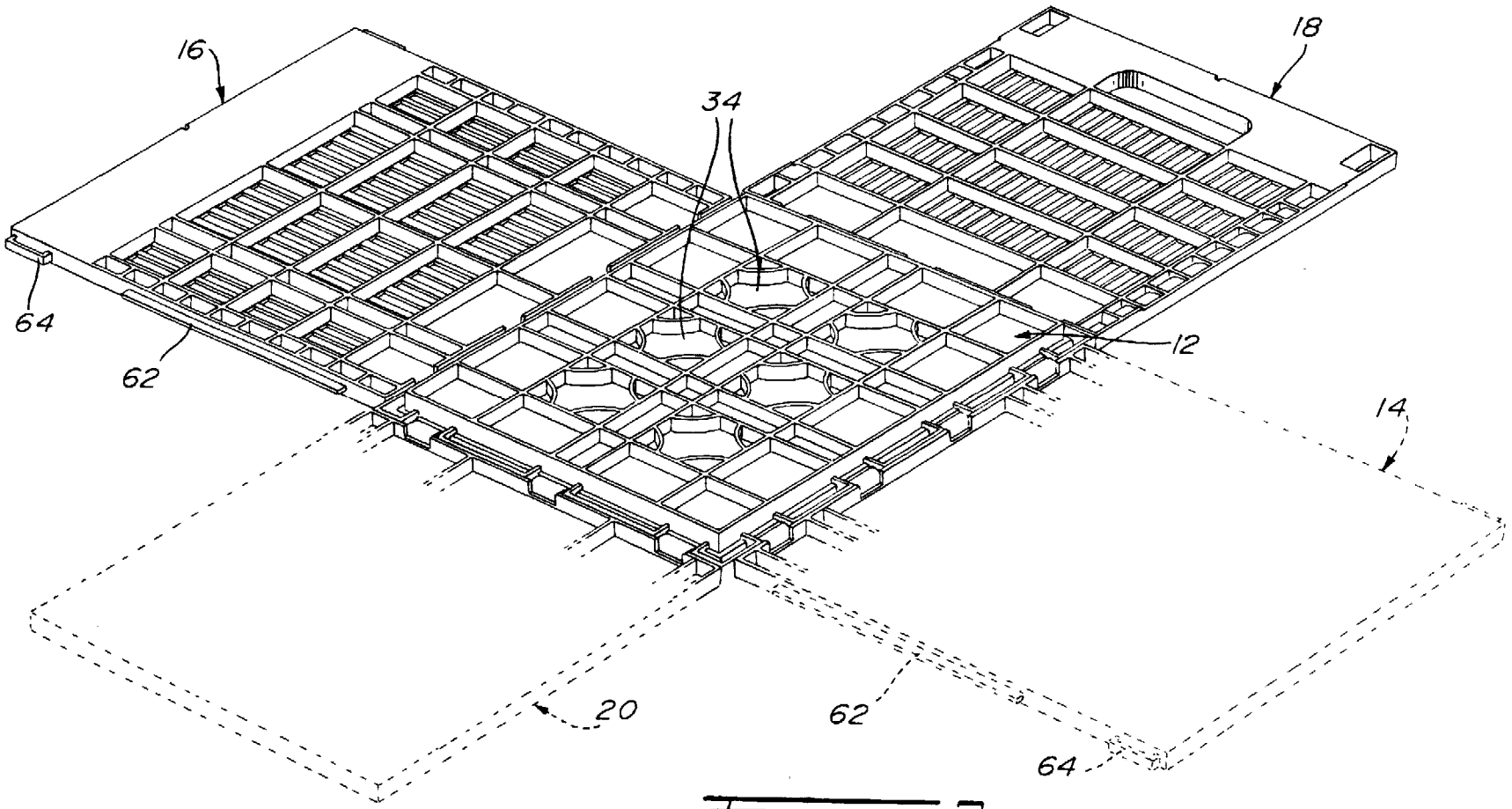
FIG. 3 is a perspective view similar to that of FIG. 2 but showing the underside of the container.

The top side of the bottom piece is recessed with respect to its side edges and end edges and displays a series of raised profiles 32 (six being shown) which serve as abutments for the lower part of bottles resting on the bottom wall 12. Each profile defines a rhomboidal configuration with concave sidewalls displaying a series of small vertical ribs 33 for reinforcement and for washing purposes. As can be seen in FIG. 3, the underside of the bottom wall 12 provides a series of recessed areas 34 with convex sidewalls which are complementary in shape to the profiles 32 so that they may nest therein as illustrated in FIG. 5.

Figure 6:
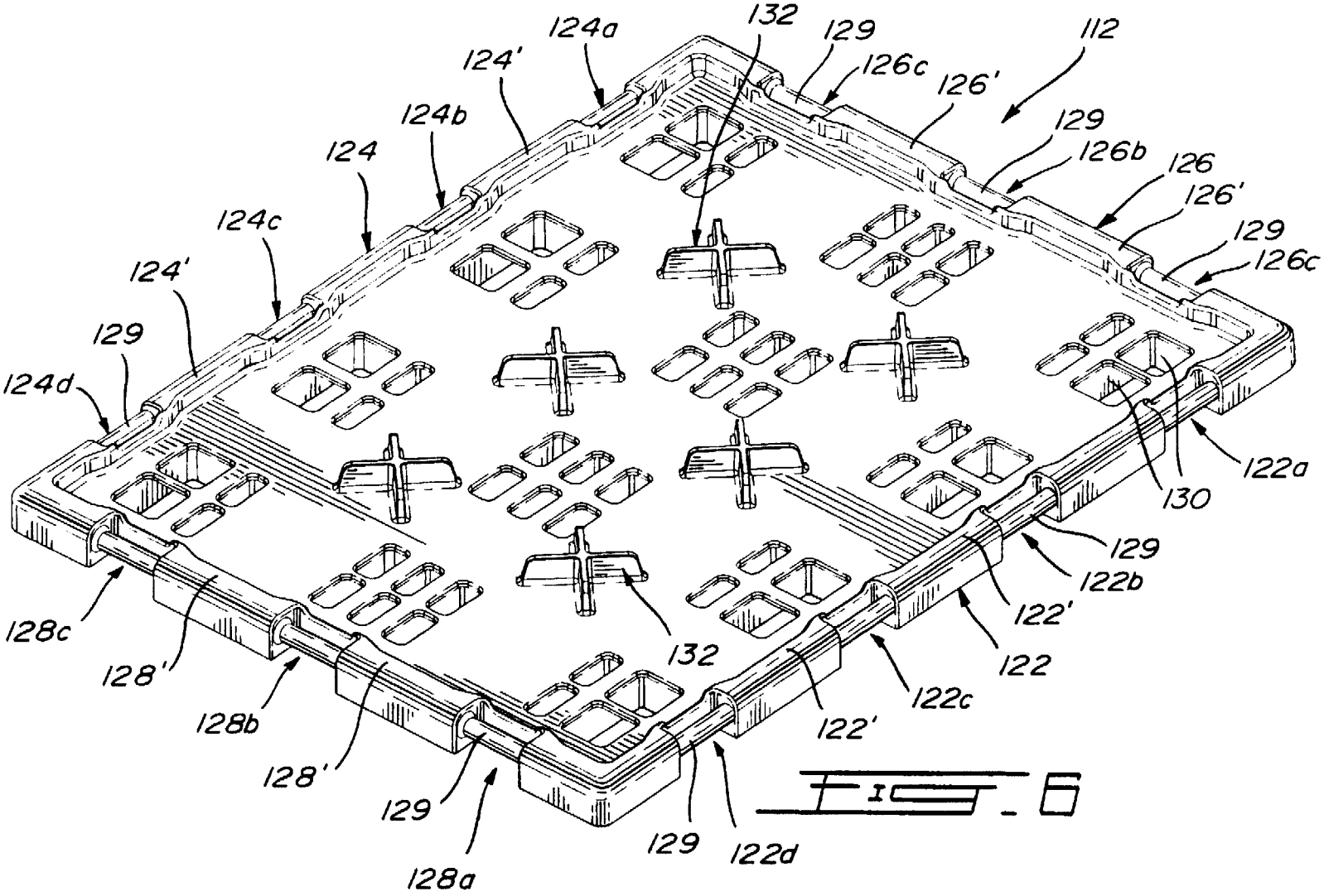
FIG. 6 is a perspective view of another embodiment of a bottom piece of a container made in accordance with the present invention.

FIG. 6 shows another embodiment of a bottom piece 112 made in accordance with the present invention and which may receive side and end pieces such as those illustrated in FIGS. 1–5.

The bottom piece 112 is rectangular with a pair of opposite side edges 122 and 124 and a pair of opposite end edges 126 and 128. In the embodiment illustrated, the side edges 122 and 124 have a length greater than that of the end edges 126 and 128. Each side edge and each end edge of the bottom piece 112 include a series of horizontally spaced recessed areas identified as 122*a*, 122*b*, 122*c* and 122*d* for side edge 122, as 124*a*, 124*b*, 124*c* and 124*d* for side edge 124, as 126*a*, 126*b* and 126*c* for end edge 126, and as 128*a*, 128*b* and 128*c* for end edge 128. Interspaced with all these recessed areas are respective planar surfaces 122', 124', 126' and 128' all extending in a common horizontal plane. Included in each recessed area is a cylindrical hinge 129 which is integrally formed with the edges.

Figure 7:
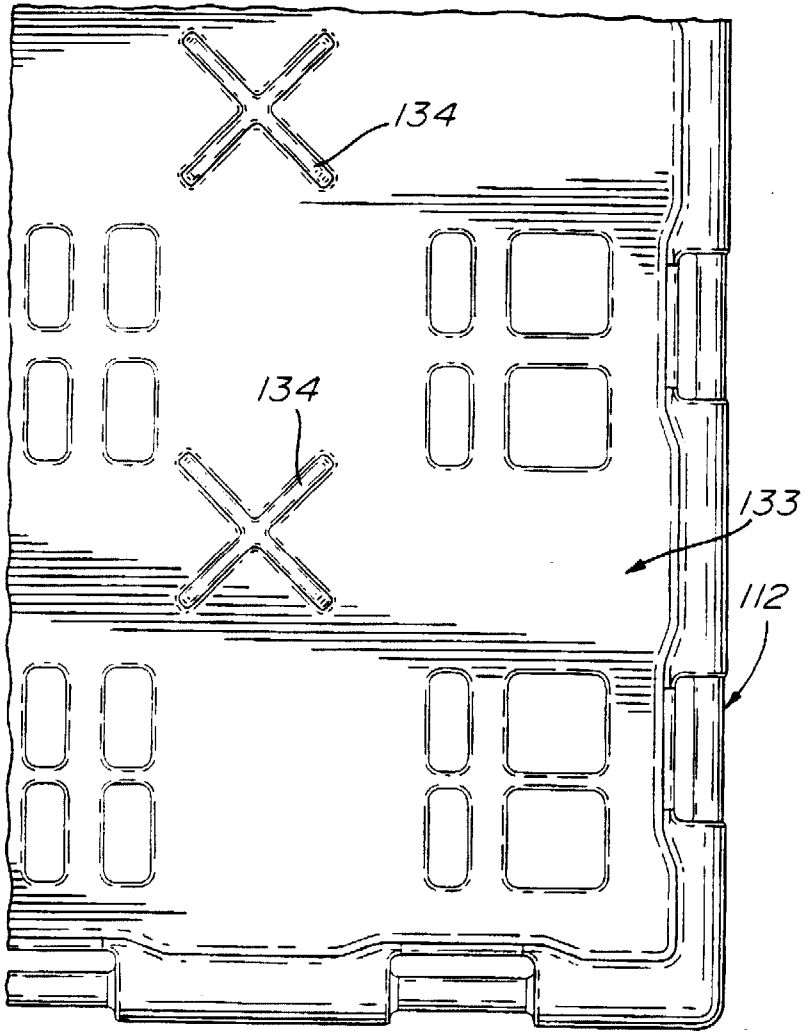
FIG. 7 is a bottom view showing part of the underside of the bottom piece of FIG. 6.

The top side of the bottom piece is recessed with respect to its side edges and end edges and displays a plurality of openings 130 that lighten the container and facilitate washing. The top side also displays a series of raised profiles 132 (six being shown) which serve as abutments for the lower part of bottles resting on the bottom 112. Each profile defines an X-shaped configuration with four sidewalls consisting of vertical ribs. As can be seen in FIG. 7, the underside 133 of the bottom wall 112 includes a series of recessed areas 134 which are complementary in shape to the profiles 132 so that they may nest therein.

Referring to FIG. 2, the lower edge of each side piece 14, 16 and of each end piece 18, 20 are identically shaped. A detailed description of every lower edge will not be given since the lower edges of both side pieces and both end pieces all have the same structural configuration.

Referring to FIG. 1, a side piece comprises, along the lower edge thereof, a series of planar faces 36*a*, 36*b* and 36*c* while an end piece 20 has a series of flat faces 38*a*, 38*b*, 38*c* and 38*d*. Interspaced with these flat surface are C-shaped extensions 40, 42 which are adapted to engage the cylindrical hinges 29 (or 129) of the bottom piece. A detailed description of this C-shaped profile of an extension that engages a cylindrical hinge may be found described in applicant's U.S. co-pending application Ser. No. 08/502,168 filed Jul. 13, 1995 and is incorporated herewith.

As can be seen in FIG. 1, when the sides 14, 16, 18 and 20 are hingedly pivoted to an erected vertical position, the flat surfaces 40 and 42 of the sides will rest upon the corresponding flat surfaces 22', 24', 26' and 28' (or 122', 124', 126' and 128') of the bottom piece, thus maintaining the sides in vertical position and preventing their inward folding. This is particularly useful when the height of the sides is greater than the width of the bottom piece such as when the height of the side pieces 14 and 16 is greater than the length of the opposite end edges 26 and 28 (126 and 128) of the bottom piece.

Since the container is made of plastics material that has some resiliency, the engagement of the C-shaped profile onto the hinges is effected through a snap-in motion; similarly, a snap-out disengagement is required in order to remove the side pieces, or end pieces, from the bottom piece. The particular connection achieved by the C-shaped extension to the hinges allows the side pieces to move from an outward foldback position to an erected position, or vice-versa.

In order to secure the side pieces and end pieces in the erected position, each has, on its opposite lateral edges, interengaging means which cooperate with complementary interengaging means on the lateral edges of adjacent side pieces. Referring to FIG. 2, one example of such interengaging means may consist of a flange 62 and a U-shaped extension 64, both of which are integrally formed with the side piece, while another interengaging means may consist of a longitudinal slot 66 and of a flexible tongue 68. The flanges 62 are received in corresponding slots 66 while the tongues 68 are flexed for subsequent connection with the U-shaped extensions 64.

The construction of the present invention is extremely useful when it is wished to return the containers for either bottle reloading, repairing or washing. For each case, the four sides are disconnected from one another and moved outwardly to lie in a horizontal plane, common with that of the bottom piece. During transport, the particular construction of the bottom piece enables containers of similar construction to be stacked in their outward foldback position with profiles 32 nestingly received in recesses 34 of superposed containers. For repairing, the damaged pieces may be disconnected from the others by snapping them out from their C-shaped and hinge connections. Thereafter, they are reconnected through a simple snap-in engagement. It is to be noted that the container may be washed with the four side pieces in a vertical position, assembled to one another and to the bottom piece.

Although the invention has been described above with respect with one specific form, it will be evident to a person skilled in the art that it may be modified and refined in various ways. It is therefore wished to have it understood that the present invention should not be limited in scope, except by the terms of the following claims.

The embodiments of the invention in which an exclusive property or privilege is claimed are defined as follows:

1. A container comprising:

a bottom piece formed of plastic, and having a top surface defining a first plane, an opposite bottom surface defining a second plane, a first pair of opposite edges, and a second pair of opposite edges, each of said edges including a plurality of parallel axially spaced apart cylindrical plastic hinge portions, said hinge portions respectively defining hinge axes, the hinge axes of all of said edges lying in a common plane between said first and second planes, each said edge further including a plurality of parallel, spaced apart ledge surfaces extending in a direction perpendicular to an axis defined by the hinge portions of the same edge, said bottom piece including, on said top surface thereof, a series of raised profiles and, on said bottom surface thereof, a series of recessed areas in vertical complementary alignment with said series of raised profiles;

a pair of plastic side pieces, each side piece having a lower plastic edge including C-shaped extensions closely resiliently receiving the hinge portions of one of the edges of the bottom piece for pivotal movement between an outward foldback position, wherein said side piece is generally coplanar with said bottom piece, and an erected position, said C-shaped extensions impeding movement of the side pieces in a direction radially away from the hinge portions except for removal of said side pieces from said bottom piece, said lower edge of respective side pieces including a series of spaced apart flat faces which are operative to engage at least some of the ledge surfaces of the bottom piece to prevent said side pieces from pivoting inwardly toward the opposite side piece to an inwardly folded position;

a pair of plastic end pieces, each end piece having a lower plastic edge including C-shaped extensions closely resiliently receiving the hinge portions of one of the edges of the bottom piece for pivotal movement between an outward foldback position, wherein said end piece is generally coplanar with said bottom piece, and an erected position, said C-shaped extensions impeding movement of the end pieces in a direction radially away from the hinge portions except for removal of said end pieces from said bottom piece, said lower edge of respective end pieces including a series of spaced apart flat faces which are operative to engage ledge surfaces of the bottom piece to prevent said end pieces from pivoting inwardly toward the opposite side piece to an inwardly folded position; and resiliently interengaging plastic surfaces on said side pieces and on said end pieces for selectively locking said side pieces to said end pieces to retain said side pieces and end pieces in the erected position wherein, when said side pieces, and end pieces are in the erected position, said side pieces and end pieces have a uniform height greater than the distance between opposite edges of one of the pairs of opposite edges of the bottom piece.

2. A five-piece container for carrying items, such as bottles, comprising:

a bottom piece formed of plastics material, said bottom piece having a top surface defining a first plane, a bottom surface defining a second plane, a pair of opposite side edges, a pair of opposite end edges; said end edges having a given length;

a pair of side pieces of identical height formed of plastics material, each side piece having a lower edge; said height being greater than said length of said end edges of said bottom piece; and a pair of end pieces of identical height formed of plastics material, each end piece having a lower edge; each said side edge and each said end edge of said bottom piece displaying a series of planar surfaces, interspaced by a series of recessed areas, and a horizontally extending integrally formed hinge traversing each said recessed area and defining an axis lying in a plane between said first and second planes;

each said lower edge of said side pieces and of said end pieces displaying a series of flat faces and a series of horizontally spaced extensions, each defining a C-shaped profile, between said faces; said extensions being so disposed along each said lower edge as to be received within a corresponding one of said recessed areas for assembly of a side piece to said bottom piece; said profiles being configured to enable snap engagement and disengagement of said extensions with and from said hinges and to allow said side pieces to be moved between an outward foldback position and an erected position; said flat faces of said side pieces and of said end pieces resting on said planar surfaces of said bottom piece in said erected position thereby preventing said side pieces and said end pieces to move inwardly to an inwardly folded position.

3. A five-piece container as defined in claim 2, wherein said side edges and said end edges of said bottom piece have identical height which is identical to the thickness of said side pieces and of said end pieces whereby, in said outward foldback position, said side pieces and said end pieces lie in a plane including that of said bottom piece.

4. A five-piece container as defined in claim 3, wherein said bottom piece has a top inner surface which is recessed with respect to said side edges and said end edges.

5. A five piece container as defined in claim 4, wherein said bottom piece displays, on said top inner surface thereof, a series of raised profiles and, on an under surface thereof, a series of recessed areas in vertical complementary alignment with said series of profiles whereby a plurality of similarly constructed containers may be vertically nested in their outward foldback position with said raised profiles of a container being received in corresponding recessed areas of a superposed container.

6. A five piece container as defined in claim as defined in claim 5, wherein said raised profiles each have a rhomboidal configuration consisting of four concave side walls.

7. A five piece container as defined in claim 5, wherein said raised profiles each have an x-shaped configuration.

8. A five-piece container as defined in claim 2, wherein each said side piece and said end piece include opposite lateral edges; said lateral edges of adjacent side and end pieces having complementary engaging means allowing said side pieces and said end pieces to be connected to one another in said erected position.

9. A five piece container as defined in claim 8, wherein said engaging means consists of flanges and flange receiving recesses and of flexible tongues and tongue engaging members.

10. A five-piece container, comprising:

a bottom piece having a top surface defining a first plane, a bottom surface defining a second plane, a pair of opposite side edges, a pair of opposite end edges; said end edges having a given length;

a pair of side pieces, each side piece having a lower edge; and a pair of end pieces, each end piece having a lower edge; each said side edge and each said end edge of said bottom piece having a series of planar surfaces, interspaced by a series of recessed areas, and a horizontally extending integrally formed hinge traversing each said recessed area and defining an axis lying in a plane between said first and second planes;

each said lower edge of said side pieces and of said end pieces having a series of flat faces and a series of horizontally spaced extensions, each defining a C-shaped profile, between said faces; said extensions being so disposed along each said lower edge as to be received within a corresponding one of said recessed areas for assembly of a side piece to said bottom piece; said profiles being configured to enable snap engagement and disengagement of said extensions with and from said hinges and to allow said side pieces to be moved between an outward foldback position and an erected position; said flat faces of said side pieces and of said end pieces resting on said planar surfaces of said bottom piece in said erected position thereby preventing said side pieces and said end pieces to move inwardly to an inwardly folded position.

* * * * *